US006579383B2

(12) United States Patent
Takemoto et al.

(10) Patent No.: US 6,579,383 B2
(45) Date of Patent: Jun. 17, 2003

(54) POWDER MAGNETIC CORE

(75) Inventors: Satoshi Takemoto, Ichinomiya (JP); Takanobu Saito, Okazaki (JP)

(73) Assignee: Daido Tokushuko Kabushiki Kaisha, Aichi (JP)

( * ) Notice: Subject to any disclaimer, the term of this patent is extended or adjusted under 35 U.S.C. 154(b) by 0 days.

(21) Appl. No.: 10/113,773

(22) Filed: Apr. 1, 2002

(65) Prior Publication Data

US 2003/0024607 A1 Feb. 6, 2003

(30) Foreign Application Priority Data

Apr. 3, 2001 (JP) ..... 2001-105017

(51) Int. Cl.[7] ..... H01F 1/22; H01F 1/28
(52) U.S. Cl. ..... 148/309; 75/246; 252/62.55
(58) Field of Search ..... 148/309; 75/246; 252/62.55

(56) References Cited

U.S. PATENT DOCUMENTS

| | | | | | |
|---|---|---|---|---|---|
| 4,101,348 | A | * | 7/1978 | Berchtold | 148/105 |
| 4,435,212 | A | * | 3/1984 | Ueshima et al. | 148/309 |
| 5,207,841 | A | * | 5/1993 | Shigeta et al. | 148/307 |
| 5,651,841 | A | * | 7/1997 | Moro et al. | 148/309 |
| 6,063,209 | A | * | 5/2000 | Matsutani et al. | 148/104 |
| 6,284,060 | B1 | * | 9/2001 | Matsutani et al. | 148/300 |
| 6,312,531 | B1 | * | 11/2001 | Matsutani et al. | 148/110 |

* cited by examiner

*Primary Examiner*—John Sheehan
(74) *Attorney, Agent, or Firm*—Frishauf, Holtz, Goodman & Chick, P.C.

(57) ABSTRACT

A powder magnetic core mainly comprises a soft magnetic powder which contains: 0.5 to 15% by mass of Si; 10% by mass or less of Al; and the balance of Fe and unavoidable impurities. The powder has an apparent density/true density falling within in a range of 0.4 to 0.55, and a volume percentage of the soft magnetic powder is 80% by volume or more. An initial permeability of the core at 100 kHz is 125 or more.

4 Claims, 1 Drawing Sheet

POWDER MAGNETIC CORE

BACKGROUND OF THE INVENTION

1. Field of the Invention

The present invention relates to a powder magnetic core, particularly to a powder magnetic core which has high permeability and can therefore be miniaturized.

2. Prior Art

A powder magnetic core has frequently been used in electric components such as a smoothing choke coil on a direct-current output side of a switching regulator, a reactor of an active filter in an inverter controller, and an operating coil of an injector for use in an internal combustion engine.

Moreover, with miniaturization of the electric component, there has been an increasing demand for miniaturization of the powder magnetic core for use in the electric component. Accordingly, there has been a demand for development of a miniaturized powder magnetic core which has excellent magnetic properties such as high permeability.

The powder magnetic core is generally manufactured as follows.

First, a soft magnetic alloy having a predetermined composition is subjected to a mechanical grinding process or an atomization process and a soft magnetic powder is manufactured. Subsequently, the soft magnetic powder is blended and entirely homogeneously mixed with a predetermined amount of an insulating binder formed, for example, of water glass, and a treatment is performed in order to enhance electric resistivity of the powder magnetic core as a manufacturing object. Subsequently, the mixture is charged into a metal mold, and molded with a predetermined pressure so that a green compact of the powder magnetic core is manufactured. Finally, the green compact is subjected to a heat treatment in order to release molding strain accumulated during the molding, and the powder magnetic core as the object is manufactured.

Moreover, to manufacture the powder magnetic core having the high permeability, it is known to be effective to highly densify the powder magnetic core and to increase the volume percentage of the soft magnetic powder in the powder magnetic core. Therefore, in the above-described manufacturing process, for example, during the molding of the green compact, a high molding pressure is applied to the green compact so that the green compact obtains a high density.

There is a problem that, however, it is difficult to manufacture a sufficiently high-permeability powder magnetic core which has an initial permeability, for example, of 125 or more, simply by raising the molding pressure.

OBJECT AND SUMMARY OF THE INVENTION

An object of the present invention is to solve the above-described problem and to provide a high-permeability powder magnetic core which has an initial permeability of 125 or more.

According to one aspect of the present invention, there is provided a powder magnetic core mainly comprising a soft magnetic powder which contains: 0.5 to 15% by mass of Si; 10% by mass or less of Al; and the balance of Fe and unavoidable impurities and whose apparent density/true density is in a range of 0.4 to 0.55, wherein a volume percentage of the soft magnetic powder is 80% by volume or more, and an initial permeability at 100 kHz is 125 or more.

Moreover, preferably in the powder magnetic core, the soft magnetic powder is manufactured by an atomization process.

Furthermore, in the powder magnetic core of the present invention, the soft magnetic powder is manufactured by homogeneously mixing at least two types of soft magnetic powders which are different from each other in an average particle diameter.

BRIEF DESCRIPTION OF THE DRAWING

The present invention will become more fully understood from the detailed description given hereinbelow and the accompanying drawing which is given by way of illustration only, and thus, is not limiting of the present invention, and wherein.

DETAILED DESCRIPTION OF THE INVENTION

Figure 1:
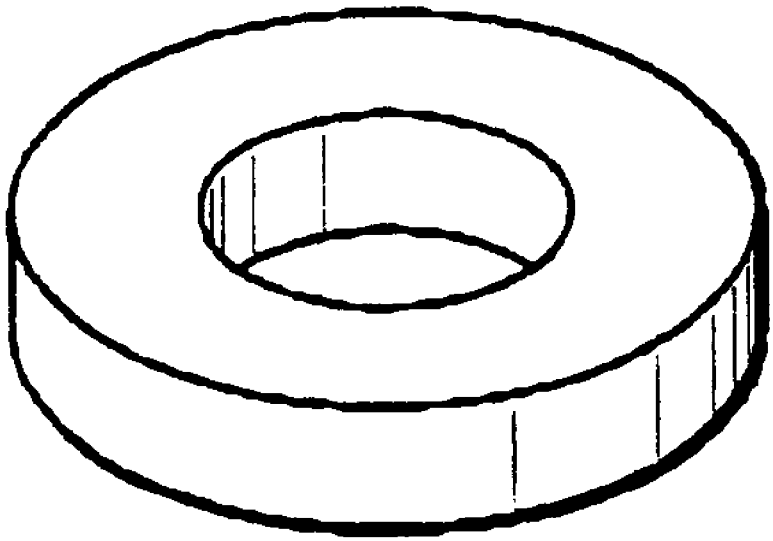
FIG. 1 is a perspective view illustrating a powder magnetic core according to an embodiment of the present invention.

The present inventors additionally examined a relation between high densification and properties of a soft magnetic powder based on a fact that a high permeability of a powder magnetic core can be realized by high densification of the powder magnetic core. A charging state of the soft magnetic powder into a metal mold changes depending on whether a particle shape of the soft magnetic powder is, for example, spherical or irregular-shaped. When the powder has an appropriate ratio of spherical particles to odd-shaped particles, the charging density is further raised. Therefore, when the particle shape of the soft magnetic powder is appropriately adjusted, the charging density of the soft magnetic powder into the metal mold can be raised, a molded green compact is highly densified, and a volume percentage of the soft magnetic powder in the powder magnetic core can be raised. Moreover, the powder having a large apparent density tends to have an approximately spherical shape, and the powder having a small apparent density tends to be odd-shaped.

Furthermore, in order to eliminate a material factor of the powder for use and generalize the above-described relation, a factor of apparent density/true density is provided, and a relation between the factor and the manufactured powder magnetic core is additionally examined. As a result, when the above-described factor, that is, the apparent density/true density is in a predetermined range, the manufactured powder magnetic core is highly densified and the permeability is also raised. Namely, based on finding these relationships, the development of the powder magnetic core of the present invention is achieved.

An embodiment of the powder magnetic core of the present invention will be described hereinafter in detail.

The powder magnetic core of the present embodiment (FIG. 1) has an initial permeability of 125 or more. Moreover, the powder magnetic core mainly comprises a soft magnetic powder whose volume percentage in the powder magnetic core is 80% by volume or more. Moreover, the balance comprises an insulating binder with which the soft magnetic powder is coated and which binds the soft magnetic powder, and a void present in the soft magnetic powder.

Additionally, the initial permeability in the present invention is a differential relative permeability in a micro alternating-current magnetic field having a frequency of 100 kHz at 0.4 A/m (5 mOe).

The soft magnetic powder contained in the powder magnetic core of the present embodiment is a powder including an Fe—Si—Al base alloy represented by Sendust, or an Fe—Si base alloy, and comprises 0.5 to 15% by mass of Si, 10% by mass or less of Al, and the balance of Fe and unavoidable impurities. Moreover, the apparent density/true density is in a range of 0.4 to 0.55.

The apparent density is a value obtained by an apparent density test method of a metal powder defined in JIS-Z-2504 (a diameter of an orifice of a funnel is 2.5 mm). When this value is large, a tendency of a spherical shape is exhibited. With a small value, a tendency of an odd shape is exhibited.

Moreover, the true density of the powder is a value obtained by a dissolved material comprising the same components. Naturally, this value differs depending on the material of the powder for use.

Therefore, in the present invention, the factor of the apparent density/true density is provided so as to compare the apparent densities among alloys having different compositions. The factor can be applied to any powder.

In this case, when the apparent density/true density is less than 0.4, particles of the powder generally have a strong tendency to be odd-shaped. Due to this tendency, the density of the powder magnetic core cannot be raised and furthermore, the electric resistance is lowered as the insulation among the particles is broken. As a result, the permeability cannot be maintained up to a high frequency of 100 kHz. Meanwhile, when the apparent density/true density exceeds 0.55, the particles of the powder become excessively spherical and a demagnetizing field to the applied magnetic field is increased. As a result, the initial permeability of 125 or more cannot be achieved.

Moreover, in the present embodiment, the above-described soft magnetic powder is preferably a homogeneous mixture of at least two types of soft magnetic powders whose average particle diameters are different from each other. This is because when the particles whose average particle diameters are different from one another are mixed, small particles are interposed in spaces formed among large particles, and the density of the powder magnetic core is raised. Additionally, even in this case, the apparent density/true density of the obtained mixture powder is set to be in a range of 0.4 to 0.55.

The powder magnetic core of the present embodiment contains 80% by volume or more of the soft magnetic powder. When this value is less than 80% by volume, the amount of the soft magnetic powder contained per unit volume of the powder magnetic core is not sufficient for achieving the initial permeability of 125 or more. Here, the volume percentage in the present invention is a value obtained by subtracting the volume of the insulating binder and that of the voids from the volume of the powder magnetic core.

A method of manufacturing the powder magnetic core of the present embodiment comprises: first preparing a molten metal or an ingot of a soft magnetic alloy having the above-described composition; and forming the molten metal or the ingot into a powder, for example, by an atomization process, or a grinding process, preferably the atomization process. Here, the atomization process may be either a water atomization process or a gas (Ar or $N_2$) atomization process. Moreover, an operation condition is adjusted in the atomization process in such a way that the apparent density/true density of the obtained powder is in a range of 0.4 to 0.55. Subsequently, the method comprises: blending the powder with a predetermined amount of insulating binder and kneading the whole material; press-molding the kneaded material to form a green compact; subjecting the green compact to an annealing treatment in order to remove molding strains; and manufacturing the powder magnetic core in which the volume percentage of the soft magnetic powder is 80% by volume or more and which has a desired shape.

EXAMPLES 1 to 9

Comparative Examples 1 to 11

The powder was manufactured from the molten alloy having the above-described predetermined composition by the water atomization process, and a 100-mesh sieve was used to sift a powder having a maximum particle diameter of 150 $\mu$m or less and an average particle diameter of 60 $\mu$m from the manufactured powder. At this time, the water atomization process was performed under the conditions where the spray pressure and water amount are controlled in such a way that the apparent density/true density of the sifted powder is in a range of 0.4 to 0.55.

Subsequently, the powder was blended with 1 to 3% by mass of water glass, the whole blend was kneaded, and the kneaded material was press-molded with a pressure of 1470 to 1960 MPa. Subsequently, the molded material was subjected to a heat treatment in an Ar atmosphere at a temperature of 700° C. for one hour, and an annular sample (see FIG. 1) having an outer diameter of 20 mm, inner diameter of 10 mm and thickness of 5 mm was prepared for measurement of permeability.

With respect to all the samples obtained in this manner, an LRC meter was used to obtain an initial permeability obtained in a micro alternating-current magnetic field of 0.4 A/m at a frequency of 100 kHz. The results are shown in Table 1 together with the alloy composition of the soft magnetic powder, apparent density/true density, and volume percentage (vol. %) of the soft magnetic powder in the powder magnetic core in each sample.

EXAMPLES 10 to 19

Comparative Examples 12 to 17

Two types of alloy powders having the same predetermined composition and different particle diameters were manufactured by the water atomization process. The 100-mesh sieve was used to sift, from one of the two types of powders, a powder (hereinafter referred to as a matrix powder) having a maximum particle diameter of 150 $\mu$m or less and average particle diameter of 60 $\mu$m. A 440-mesh sieve was used to sift a powder (hereinafter referred to as a fine powder) having a maximum particle diameter of 30 $\mu$m or less and average particle diameter of 10 $\mu$m from the other powder. Subsequently, the matrix powder was mixed with the fine powder at a predetermined ratio to prepare a mixture powder. At this time, the matrix powder and fine powder were manufactured by the water atomization process under the conditions where the spray pressure and water amount are controlled in such a way that the apparent density/true density of the mixture powder is in a range of 0.4 to 0.55.

Subsequently, the samples for measuring the permeability were prepared similarly as Examples 1 to 9 except that the mixture powder was used as the soft magnetic powder, and each initial permeability was measured. The results are shown in Table 2 together with the alloy composition of the soft magnetic powder, mass concentration (wt. %) of the fine powder in the mixture powder, apparent density/true density of each of the matrix powder and mixture powder, and volume percentage (vol. %) of the mixture powder in the powder magnetic core in each sample. Additionally, for reference, the measurement results of Examples 2, 3, 7, 8, 9 and Comparative Example 2 are also shown in Table 2.

TABLE 1

| | Soft magnetic powder | | Powder magnetic core | |
|---|---|---|---|---|
| | Alloy composition | Apparent density/true density | Volume percentage of soft magnetic powder (vol %) | Initial permeability (100 kHz) |
| Comp. ex. 1 | Fe-9.5% Si-5.5% Al | 0.36 | 81 | 85 |
| Comp. ex. 2 | Fe-9.5% Si-5.5% Al | 0.36 | 77 | 110 |
| Example 1 | Fe-9.5% Si-5.5% Al | 0.41 | 82 | 135 |
| Example 2 | Fe-9.5% Si-5.5% Al | 0.45 | 83 | 140 |
| Example 3 | Fe-9.5% Si-5.5% Al | 0.49 | 83 | 135 |
| Example 4 | Fe-9.5% Si-5.5% Al | 0.52 | 83 | 130 |
| Comp. ex. 3 | Fe-9.5% Si-5.5% Al | 0.52 | 78 | 70 |
| Comp. ex. 4 | Fe-9.5% Si-5.5% Al | 0.56 | 83 | 95 |
| Comp. ex. 5 | Fe-9.5% Si-5.5% Al | 0.45 | 78 | 85 |
| Example 5 | Fe-9.5% Si-5.5% Al | 0.45 | 81 | 130 |
| Example 6 | Fe-9.5% Si-5.5% Al | 0.45 | 83 | 160 |
| Comp. ex. 6 | Fe-6.5% Si | 0.35 | 81 | 70 |
| Example 7 | Fe-6.5% Si | 0.45 | 83 | 135 |
| Comp. ex. 7 | Fe-6.5% Si | 0.57 | 83 | 100 |
| Comp. ex. 8 | Fe-1% Si | 0.35 | 81 | 65 |
| Example 8 | Fe-1% Si | 0.45 | 83 | 130 |
| Comp. ex. 9 | Fe-1% Si | 0.57 | 83 | 95 |
| Comp. ex. 10 | Fe-14% Si-9% Al | 0.35 | 81 | 80 |
| Example 9 | Fe-14% Si-9% Al | 0.45 | 82 | 130 |
| Comp. ex. 11 | Fe-14% Si-9% Al | 0.57 | 82 | 100 |

TABLE 2

| | Soft magnetic powder | | | | Powder magnetic core | |
|---|---|---|---|---|---|---|
| | Alloy composition | Apparent density/true density of matrix powder | Mass concentration of fine powder (wt. %) | Apparent density/true density of mixture powder | Volume percentage of soft magnetic powder (vol. %) | Initial permeability (100 kHz) |
| Example 2 | Fe-9.5% Si-5.5% Al | 0.45 | — | — | 83 | 140 |
| Example 10 | Fe-9.5% Si-5.5% Al | 0.45 | 30 | 0.48 | 85 | 165 |
| Example 11 | Fe-9.5% Si-5.5% Al | 0.45 | 50 | 0.51 | 83.5 | 145 |
| Comp. ex. 12 | Fe-9.5% Si-5.5% Al | 0.45 | 70 | 0.56 | 78 | 110 |
| Example 3 | Fe-9.5% Si-5.5% Al | 0.49 | — | — | 83 | 135 |
| Example 12 | Fe-9.5% Si-5.5% Al | 0.49 | 30 | 0.51 | 83 | 130 |
| Comp. ex. 13 | Fe-9.5% Si-5.5% Al | 0.49 | 50 | 0.56 | 79 | 115 |
| Comp. ex. 2 | Fe-9.5% Si-5.5% Al | 0.36 | — | — | 77 | 110 |
| Example 13 | Fe-9.5% Si-5.5% Al | 0.36 | 30 | 0.42 | 81 | 135 |
| Comp. ex. 14 | Fe-9.5% Si-5.5% Al | 0.36 | 50 | 0.45 | 79 | 115 |
| Example 7 | Fe-6.5% Si | 0.45 | — | — | 83 | 135 |
| Example 14 | Fe-6.5% Si | 0.45 | 30 | 0.49 | 83 | 160 |
| Example 15 | Fe-6.5% Si | 0.45 | 50 | 0.52 | 84 | 140 |
| Comp. ex. 15 | Fe-6.5% Si | 0.45 | 70 | 0.57 | 78 | 105 |
| Example 8 | Fe-1% Si | 0.45 | — | — | 83 | 130 |
| Example 16 | Fe-1% Si | 0.45 | 30 | 0.49 | 84 | 140 |
| Example 17 | Fe-1% Si | 0.45 | 50 | 0.52 | 83 | 130 |
| Comp. ex. 16 | Fe-1% Si | 0.45 | 70 | 0.57 | 78 | 105 |
| Example 9 | Fe-14% Si-9% Al | 0.45 | — | — | 82 | 130 |
| Example 18 | Fe-14% Si-9% Al | 0.45 | 30 | 0.48 | 83 | 145 |
| Example 19 | Fe-14% Si-9% Al | 0.45 | 50 | 0.51 | 83 | 130 |
| Comp. ex. 17 | Fe-14% Si-9% Al | 0.45 | 70 | 0.56 | 78 | 105 |

As apparent from Tables 1 and 2, for the samples of the examples in which the apparent density/true density of the soft magnetic powder or the mixture powder is 0.4 to 0.55, and the volume percentage of the soft magnetic powder is 80% by volume or more, the initial permeability is 125 or more.

Moreover, as seen from Table 2, when the amount of the fine powder in the mixture powder is 30% by mass, the apparent density/true density of the mixture powder or the volume percentage of the mixture powder in the powder magnetic core increases. Accordingly, the initial permeability of the powder magnetic core also increases. This is supposedly because the particles of the fine powder are just positioned in spaces formed among the particles of the matrix powder each having a diameter larger than that of the particles of the fine powder and the volume percentage of the soft magnetic powder increases.

As apparent from the above description, for the powder magnetic core of the present invention, the alloy composition and apparent density/true density of the soft magnetic powder as the main component and the volume percentage of the soft magnetic powder in the powder magnetic core are set within the predetermined ranges, so that a high initial permeability of 125 or more is achieved. Therefore, the powder magnetic core of the present invention is suitable for miniaturization.

Additionally, the present invention is not limited to the above-described embodiment, and can variously be modified without departing from the scope of the present invention. For example, the shape of the powder magnetic core can appropriately be set in accordance with a use method of the powder magnetic core.

What is claimed is:

1. A powder magnetic core comprising a soft magnetic powder, said powder consisting of: 0.5 to 15% by mass of Si; 10% by mass or less of Al; and the balance of Fe and unavoidable impurities, wherein said powder has an apparent density/true density falling within a range of 0.4 to 0.55, a volume percentage of said powder is 80% by volume or more and an initial permeability of said core at 100 kHz is 125 or more.

2. The powder magnetic core according to claim 1, wherein said soft magnetic powder has been manufactured by an atomization process.

3. The powder magnetic core according to claim 1, wherein said soft magnetic powder contains at least two types of soft magnetic powders whose average particle diameters are different from each other.

4. The powder magnetic core according to claim 2, wherein said soft magnetic powder contains at least two types of soft magnetic powders whose average particle diameters are different from each other.

* * * * *